US005182556A

United States Patent [19]

Plost et al.

[11] Patent Number: 5,182,556

[45] Date of Patent: Jan. 26, 1993

[54] DRAIN PLUG ABSENCE INDICATOR

[76] Inventors: Gerald N. Plost, 1729 E. 19th, Tulsa, Okla. 74104; Henry A. Hodgson, 1410 E. 33rd, Tulsa, Okla. 74105

[21] Appl. No.: 676,871

[22] Filed: Mar. 28, 1991

[51] Int. Cl.[5] ..... G08B 23/00; B63B 13/00

[52] U.S. Cl. ..... 340/984; 114/197; 116/26; 340/568; 340/686

[58] Field of Search ..... 340/984, 686, 568, 687, 340/605; 114/197; 200/61.42, 61.44, 81.9 M, 183, 184, 187; 116/26, 112, 204, 265

[56] References Cited

U.S. PATENT DOCUMENTS

| | | | |
|---|---|---|---|
| 2,470,066 | 5/1949 | Caladrese | 174/152 |
| 3,309,687 | 3/1967 | Phipps | 340/244 |
| 3,821,699 | 6/1974 | Marus et al. | 340/686 |
| 3,896,280 | 7/1975 | Blake | 340/686 |
| 4,211,991 | 7/1980 | Lombard | 335/207 |
| 4,341,178 | 7/1982 | Price | 114/183 |
| 4,516,515 | 5/1985 | Johnson | 114/197 |
| 4,542,373 | 9/1985 | Hillock | 340/686 |
| 4,630,036 | 12/1986 | Ford | 340/622 |
| 4,843,376 | 6/1989 | Wagner et al. | 340/568 |
| 4,930,657 | 6/1990 | Walker | 114/197 |
| 5,047,753 | 9/1991 | Birchfield | 340/686 |

*Primary Examiner*—Jin F. Ng

*Assistant Examiner*—Brent A. Swarthout

[57] ABSTRACT

Apparatus for indicating the absence of a drain plug in a boat drain when the boat is in a launch condition includes an electrically activated alarm connected in series with an electrical power source and a control circuit for connecting and disconnecting the alarm to the power source. The control circuit is contained in a housing mounted proximate the boat drain on an exterior portion of the boat and includes a normally open switch closable by immersion of the contacts in water and normally closed switch operable in response to an actuator mounted on the drain plug so that, when the drain plug is properly seated in the boat drain, the actuator will throw the switch to an open condition. Thus, if the drain plug is not properly seated in the drain when the boat is launched into the water, the control circuit will be completed by immersion of the first switch in the water and the alarm will be activated. However, if the drain plug is properly seated, the second switch will be in an open condition and the alarm will not be activated, even when the boat is in a launch condition. The housing can be mounted proximate the drain in a position such that the first switch is immersed at a level at or below the level of the drain so that the alarm will be activated prior to the entry of water into the drain.

14 Claims, 1 Drawing Sheet

DRAIN PLUG ABSENCE INDICATOR

BACKGROUND OF THE INVENTION

This invention relates generally to accessories for water craft and more particularly concerns devices for signalling the absence of a drain plug from a boat drain when the boat is in a launch condition.

Prior art devices directed at saving the boating enthusiast from the embarrassment, aggravation and work resulting from launching a boat with an open drain fall into two basic categories. One category includes those devices responsive solely to the physical presence of a plug in the drain. In this category the alarm indicia are activated by the presence or absence of the plug in the drain and the alarm is activated regardless of the launch condition of the craft. For visual indicators which do not constantly bombard the senses, this can be an acceptable arrangement, but such indicators are inadequate in actual launch conditions because they require the boatman to physically observe the indicia. The boatman is still reliant on memory to check for the presence of the plug by looking at the indicia. For audio indicators of this type, the plug must always be in the drain, even if the boat is not in a launch condition, to prevent a constant sounding alarm. Of course, a manual interrupt could be used to disconnect the circuit, but such an interrupt would, be self-defeating since it would disconnect the system and again place the burden of memory on the boatman. The other category includes those devices responsive to the presence of water to activate the alarm. Some water responsive devices are presently known, but are actuated by either the presence of water in or the flow of water into the boat. Consequently, while such devices are satisfactory to minimize the embarrassment, aggravation and work above referred to, they do not eliminate it.

An additional problem with known indicator devices is that they require insertion and removal of the drain plug from a position inside of the boat. This can be a very inconvenient operation, particularly when the drain plug is located beneath floor boards or is inaccessible due to the presence of other boat equipment such as engines, pumps and the like.

It is therefore an object of the present invention to provide a drain plug absence indicator which gives an audible warning only if the boat is in a launch condition and the drain plug is absent from the drain. Another object of the present invention is to provide a drain plug absence indicator capable of giving an alarm prior to the flow of water through the drain. And it is an object of the present invention to provide a drain plug indicator which allows insertion and removal of the drain plug from a position outside of the boat.

SUMMARY OF THE INVENTION

In accordance with the invention, apparatus is provided for indicating the absence of a drain plug in a boat drain when the boat is in a launch condition. The apparatus includes an electrically activated alarm, such as a horn, connected in series with an electrical power source, such as the 12 volt battery normally associated with a boat's electrical system, and a control circuit for connecting and disconnecting the alarm to the power source. The control circuit is contained in a housing mounted proximate the boat drain on an exterior portion of the boat. The circuit includes a pair of spaced apart electrical contacts exposed externally of the housing so that immersion of the contacts in water will complete the electrical connection between them. The circuit also includes a mechanically operable switch, such as a magnetically actuated reed switch, which is in a normally closed condition. A switch actuator, such as a magnet in the case of the magnetically actuated reed switch, is mounted on the drain plug in such a fashion that, when the drain plug is properly seated in the boat drain, the actuator will throw the switch to an open condition. Thus, if the drain plug is not properly seated in the drain when the boat is launched into the water, the control circuit will be completed by immersion of the spaced apart contacts in the water and the alarm will be activated. However, if the drain plug is properly seated, the mechanically actuated switch will be in an open condition and the alarm will not be activated, even when the boat is in a launch condition. The housing can be mounted proximate the drain in a position such that the water connectible spaced apart contacts are at a level at or below the level of the drain. Thus, the alarm will be activated prior to the entry of water into the drain.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
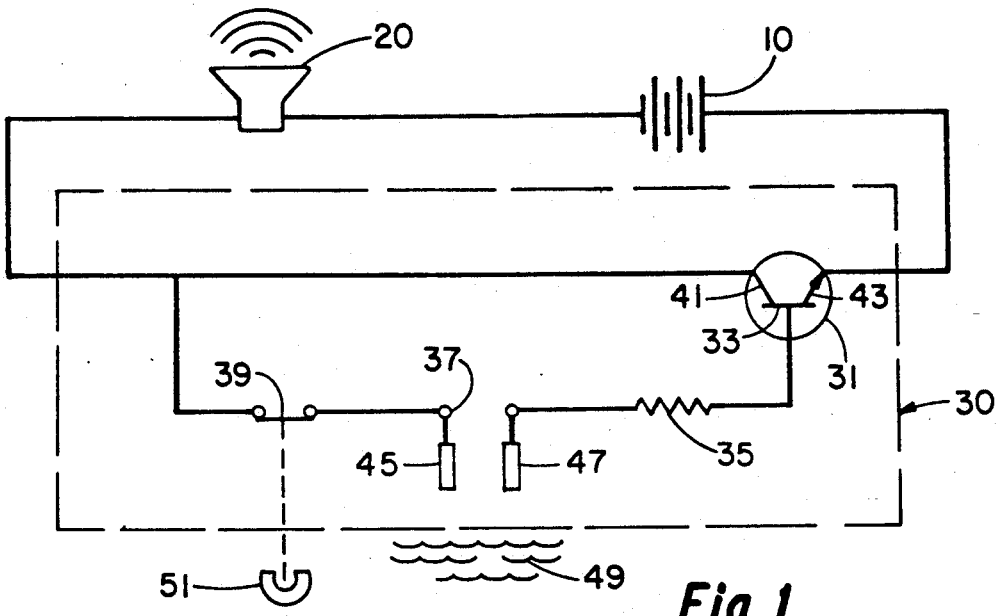
FIG. 1 is a schematic diagram of a preferred embodiment of the power and control circuits of the present invention.

Turning first to FIG. 1, a schematic diagram of a preferred embodiment of the drain plug absence indicator is illustrated. The circuit includes series connected power source 10, such as the 12 volt battery normally used to power a boat's electrical system, alarm indicator 20, preferably audible such as a horn or bell, and control circuit 30 for controlling the electrical connection between the power source 10 and the alarm 20.

In the preferred embodiment of the control circuit 30 illustrated in FIG. 1, control is accomplished by use of an N-P-N transistor 31 having its base 33 connected in series through a current limiting resistor 35, a first switch 37 and a second switch 39 to its collector 41. Its emitter 43 and collector 41 are connected in series with the power source 10 and the alarm 20. As shown, the first switch 37 is normally open and the second switch 39 is normally closed.

Preferably, the first switch 37 consists of a pair of spaced apart contacts 45 and 47. When the contacts 45 and 47 are immersed in water 49, the electrical connection between them is completed, closing the switch 37. The second switch 39 is normally closed and is preferably a magnetic reed switch which may be actuated by a magnet 51 to throw the switch 39 to an open condition.

Figure 2:
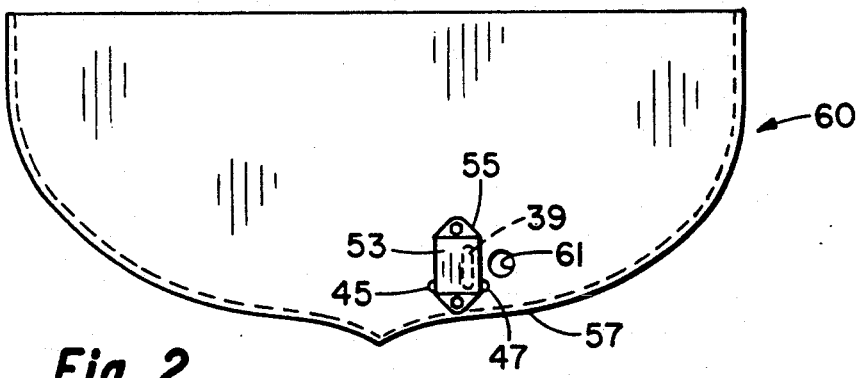
FIG. 2 is a rear elevational view illustrating a preferred embodiment of the control circuit housing of the present invention mounted on an exterior stern portion of a boat.

As is illustrated in FIG. 2, the stern 60 of the boat includes a drain 61. Mounted on the stern 60 of the boat is a housing 53 which contains the control circuit 30. The housing 53 may be typically approximately 1 ½ inches square and ⅝ inch thick and provided with flanges 55 and 57 by which the housing 53 may be screwed in place on the stern 60. Other configurations are of course possible depending on the specific circuit elements employed. The spaced apart contacts 45 and 47 are exposed on the exterior of the housing 53 and the reed switch 39 is disposed within the housing 53. The housing 53 is mounted on the stern 60 proximate the drain 61, preferably in a relationship such that the contacts 45 and 47 are at a level approximately even with or below the level of the drain 61 and such that the reed switch 39 is proximate the drain 61, for reasons to hereinafter become apparent. Preferably, the housing 53 forms a watertight enclosure protecting the control circuit 30.

Figure 3:
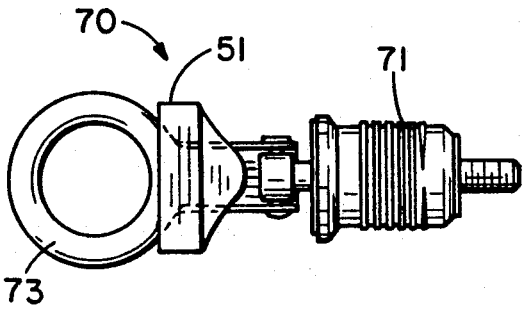
FIG. 3 is a side elevational view of a preferred embodiment of an improved drain plug for use with the present invention.
Figure 4:
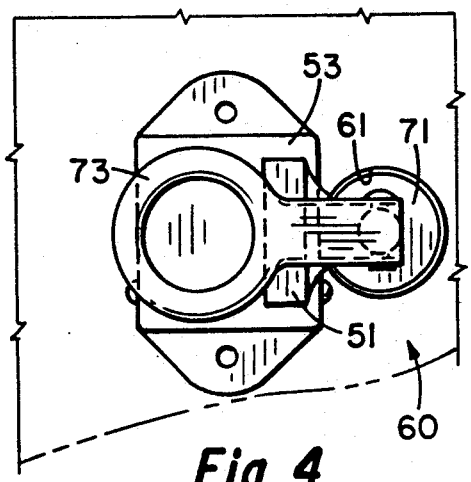
FIG. 4 is a rear elevational view illustrating the plug of FIG. 3 used in conjunction with the housing illustrated in FIG. 2.

Turning to FIGS. 3 and 4, a typical drain plug 70 for use with the boat drain 61 is illustrated which consists of a stopper portion 71 insertable in the drain 61 and a latching mechanism 73 which may be snapped to expand the stopper portion 71 and thus secure it within the drain 61. For the purposes of the present invention, the drain plug 70 has been improved by mounting the magnet 51 on it in such a position that, when the drain plug 70 is inserted in the drain 61 and the latching mechanism is moved into place, the magnet 51 will be juxtaposed in relation to the magnetic reed switch 39 to throw the switch 39 into an open condition. Of course, different types of switches may require different improvements to the plug.

In practice, the housing 53 containing the control circuit 30 will be screwed into position on the stern 60 of the boat proximate the drain 61 with the contacts 45 and 47 approximately at or below the level of the drain 61. The alarm 20 will be mounted in any desired position, preferably on the boat but possibly on the vehicle used to tow the boat. The control circuit 30 and the alarm 20 are connected to the power source 10 which, as was earlier mentioned, may be the battery normally associated with the boat's electrical system. An independent power source could of course be used. With the circuit thus connected, the user need do nothing more to accomplish its effective operation. If the boat is placed in a launch condition, that is the boat is either in the process of being launched or has already been launched into the water 49 when the drain plug 70 is not present in the drain 61, the second switch 39 will be in its normally closed condition. When the boat is launched to the point that the contacts 45 and 47 become immersed in the water 49, the first switch 37 will be closed, completing the control circuit 30 and thus energizing the alarm 20. However, if the improved drain plug 70 is inserted in the drain 61, the juxtaposition of the magnet 51 with the reed switch 39 will cause the normally closed reed switch 39 to open, preventing the alarm from operating regardless of whether the contacts 45 and 47 have been immersed in the water 49 or not.

Thus it can be seen that, in its normal condition, the circuit 30 is disconnected and no load is imposed upon the power source 10. Furthermore, the only time that the circuit 30 will be energized is during the simultaneous occurrence of the absence of the drain plug 70 and the immersion of the contacts 45 and 47 in the water 49. It should also be noted that the drain plug 70 is inserted and removed from the drain 61 from a position exterior to the boat and also that, by appropriate positioning of the housing 53, the alarm 20 will be sounded before the water 49 begins to enter the drain 61.

It will be obvious to one skilled in the art that a wide variety of control circuits and switching mechanisms equivalent to the control circuit 30 and the switches 37 and 39 herein illustrated may be employed. It is only essential that the on/off condition of the circuit be determined by a normally closed switch which will be opened in response to the presence of a drain plug in the drain and that by a normally open switch which will be closed in response to the presence of water at a selected level in relation to the drain.

Thus, it is apparent that there has been provided, in accordance with the invention, a drain plug absence indicator that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. Apparatus for indicating the absence of a drain plug in a boat drain when the boat is in a launch condition comprising:

an electrically activated alarm means;

a power source electrically connected to said alarm means; and circuit means mounted on an exterior portion of the boat for controlling the electrical connection between said alarm means and said power source, said circuit means having a normally open switching means for closing in response to immersion thereof into water, said normally open switching means electrically series connected with a normally closed switching means; and an operating means for sensing the presence of the drain plug in the drain and for opening said normally closed switching means in response to said sensing by the operating means.

2. Apparatus according to claim 1, said normally open switching means comprising a pair of spaced apart electrical contacts.

3. Apparatus according to claim 2, said contacts being disposed at a level approximately at or below the level of the drain.

4. Apparatus according to claim 1, said normally closed switching means comprising a magnetically operated reed switch.

5. Apparatus according to claim 4 further comprising magnet means mounted on the drain plug for operable juxtaposition in relation to said reed switch when the plug is inserted in the drain.

6. Apparatus for indicating the absence of a drain plug in a boat drain when the boat is in a launch condition comprising:

a drain plug;

an electrically activated alarm means;

a power source electrically connected to said alarm means; and circuit means mounted on an exterior portion of the boat for controlling the electrical connection between said alarm means and said power source, said circuit means having a normally open switching means for closing in response to immersion thereof into water, said normally open switching means electrically series connected with a normally closed switching means; and an operating means mounted on said drain plug for opening said normally closed switching means when said drain plug is in an inserted condition in the drain.

7. Apparatus according to claim 6, said normally open switching means comprising a pair of spaced apart electrical contacts.

8. Apparatus according to claim 7, said contacts being disposed at a level approximately at or below the level of the drain.

9. Apparatus according to claim 6, said normally closed switching means comprising a magnetically operated reed switch.

10. Apparatus according to claim 9, said operating means comprising magnet means for operable juxtaposition in relation to said reed switch when said drain plug is inserted in the drain.

11. Apparatus for indicating the absence of a drain plug in a boat drain when the boat is in a launch condition comprising:

a drain plug;

a magnet mounted on said drain plug;

an electrically activated alarm means;

a power source electrically connected to said alarm means;

a housing mounted on an exterior portion of the boat proximate the drain; and circuit means disposed within said housing and electrically connected in series with said alarm means and said power source, said circuit means having connected in series a pair of normally disconnected electrical contacts external to said housing electrically connected by immersion thereof into water and a normally closed reed switch opened in response to said magnet when said drain plug is in an inserted condition in the drain.

12. Apparatus according to claim 11, said alarm means being an audible signal generator.

13. Apparatus according to claim 11, said power source being mounted on the boat.

14. Apparatus according to claim 11, said housing being mounted with said contacts at a level approximately at or below the level of the drain.

* * * * *